US006880372B2

(12) United States Patent
Kim

(10) Patent No.: US 6,880,372 B2
(45) Date of Patent: Apr. 19, 2005

(54) SECURITY DEVICE FOR INFORMATION STORAGE MEDIA

(76) Inventor: Jae-tae Kim, 20515 Como La., Northridge, CA (US) 91326

( * ) Notice: Subject to any disclaimer, the term of this patent is extended or adjusted under 35 U.S.C. 154(b) by 0 days.

(21) Appl. No.: 10/680,385

(22) Filed: Oct. 8, 2003

(65) Prior Publication Data

US 2004/0177657 A1 Sep. 16, 2004

(30) Foreign Application Priority Data

Mar. 10, 2003 (KR) ..... 10-2003-0014677
Sep. 3, 2003 (KR) ..... 10-2003-0061546

(51) Int. Cl.[7] ..... E05B 65/00

(52) U.S. Cl. ..... 70/57.1; 206/308.2; 206/387.11; 206/1.5; 292/252

(58) Field of Search ..... 292/251.1, 252; 70/57.1, 58, 63, 276; 206/1.5, 308.1, 308.2, 387.11

(56) References Cited

U.S. PATENT DOCUMENTS 3,757,551 A * 9/1973 Willach ..... 70/276
4,652,029 A * 3/1987 Yamamoto ..... 292/252
5,106,132 A * 4/1992 Bako et al. ..... 292/128
5,140,836 A * 8/1992 Hogan et al. ..... 70/57.1
5,147,034 A * 9/1992 Broadhead et al. ..... 206/1.5
5,518,282 A * 5/1996 Sawada ..... 292/252
5,588,315 A * 12/1996 Holmgren ..... 70/57.1
5,598,728 A 2/1997 Lax
5,718,332 A * 2/1998 Tachibana ..... 206/308.2
5,760,689 A * 6/1998 Holmgren ..... 340/568.8
5,769,218 A * 6/1998 Yabe ..... 206/308.2
5,850,752 A 12/1998 Lax
5,882,052 A * 3/1999 Whitehead ..... 292/80
5,988,376 A 11/1999 Lax
6,336,554 B1 * 1/2002 Bruhwiler ..... 206/308.2
6,374,648 B1 * 4/2002 Mitsuyama ..... 70/57.1
6,430,976 B1 * 8/2002 Mitsuyama ..... 70/57.1
6,467,318 B1 * 10/2002 Gattiker ..... 70/57.1
6,561,347 B1 * 5/2003 Lax ..... 206/308.2
6,601,414 B1 * 8/2003 Chang ..... 70/57.1
6,601,415 B1 * 8/2003 Takinami ..... 70/57.1
6,601,702 B1 * 8/2003 Byrne et al. ..... 206/387.11
6,619,079 B1 * 9/2003 Cheung ..... 70/57.1
6,666,330 B1 * 12/2003 Sedon et al. ..... 206/387.11
6,672,455 B1 * 1/2004 Belden et al. ..... 206/308.2
6,719,136 B1 * 4/2004 Sankey et al. ..... 206/387.11
2002/0003095 A1 * 1/2002 Jaeb et al. ..... 206/308.2
2002/0023853 A1 * 2/2002 Lax et al. ..... 206/310
2002/0194888 A1 * 12/2002 Mitsuyama ..... 70/57.1
2003/0000856 A1 * 1/2003 Lax et al. ..... 206/310
2003/0098252 A1 * 5/2003 Sykes et al. ..... 206/308.2
2003/0111367 A1 * 6/2003 Lax et al. ..... 206/308.2
2003/0116454 A1 * 6/2003 Marsilio et al. ..... 206/308.2
2003/0116455 A1 * 6/2003 Marsilio et al. ..... 206/308.2
2003/0126839 A1 * 7/2003 Hoogland ..... 53/473
2003/0177797 A1 * 9/2003 Storvick et al. ..... 70/276
2003/0196917 A1 * 10/2003 Broadhead ..... 206/308.2

* cited by examiner

*Primary Examiner*—Suzanne Dino Barrett
(74) *Attorney, Agent, or Firm*—Dickstein Shapiro Morin & Oshinsky LLP

(57) ABSTRACT

A security device includes a case for retaining an information storage device in the space between a front case and a rear case, plurality of locking sleeves protruding from the front case and the rear case, the locking sleeves is formed to engage each other in the manner that the holes of the locking sleeves are aligned in a closed position of the case, and a locking mechanism for latching the case, the locking mechanism inserted into the aligned holes of said locking sleeves in closed position of the case. The locking mechanism includes a housing, a hook which is selectively locked to the protrusion formed on the locking sleeve and released from it by extruding from the case and pulling back into the case, a moving member which is mounted on the slope and moves up and down the slope by magnetic force, while contacting with the side surface of the hook. The hook moves to the locking position or releasing position as the moving member goes up and down the slope.

13 Claims, 15 Drawing Sheets

SECURITY DEVICE FOR INFORMATION STORAGE MEDIA

CROSS-REFERENCE TO RELATED APPLICATIONS

This application claims the benefit of Korean Patent Applications Nos. 2003-14677 filed on Mar. 10, 2003, and 2003-61546 filed on Sep. 3, 2003, in the Korean Intellectual Property Office, the disclosure of which is incorporated herein by reference.

BACKGROUND OF THE INVENTION

1. Field of the Invention

The present invention relates to the security device for preventing an information storage media like DVD, CD and video tape from pilferage, and more specifically to the security devices which has locking function and the locking status can only be released by a decoupler.

2. Description of the Prior Art

The information storage media like DVD, CD are displayed in the retail store or rental store contained in a case. Because of the small size of the information storage media, pilferage is occurring frequently. Recently, security devices, equipped with locking function that can only be released by the decoupler installed at the counter, are widely used.

U.S. Pat. No. 5,598,728, U.S. Pat No. 5,850,752 and U.S. Pat. No. 5,988,376 disclose the above said prior arts.

In FIG. 1 through FIG. 3 are shown the prior art as disclosed in above patents.

As shown in FIG. 1, the prior art of security device includes a case 100 for receiving merchandise, and locking mechanism 200 for latching the case closed. The case 100 has a notch 110, 120 at the lower portion of both sides. The locking mechanism 200 is comprised of a housing 230 with a flange 232 which covers the lower part of case 100; a fixed hook 210 which is installed at one end of the housing; and a movable hook 220 which is movably installed at the other end of the housing 230. The locking operation is as follows: the fixed hook 210 is inserted in the notch 120 provided at one side of the case 100, and then the movable hook 220 moves to the locking position thus being inserted into the other notch 120 on the other side of the case 100.

As shown in FIG. 2, the movable hook 220 has a extended member 222 which is extended toward the inner part of the housing 230. A cross piece 224 with a curved segment 224*a* at the center portion is provided under the extended member 222. A pair of opposing sleeves 240 are formed on the inner wall of the housing 230. Each sleeve 240 has a steel pin 242 which contacts the cross piece 224 and supported by a spring 241 installed in the sleeve. The movable hook 220 moves to locking location and fixed in that location by the steel pin 242 which exerts force from the spring 241 on the both sides of the cross piece 224. Meanwhile, a front surface 223 of the extended member 222 is supported by an additional spring 250. When the steel pin 242 is released from the cross piece 224, spring pushes back the movable hook 220 to the releasing position located outside of the housing 230 thus releasing the movable hook 220 from the notch 120 of the case 100.

As shown in FIG. 3, the releasing operation of the movable hook 220 is made by a decoupler 300. The decoupler 300 is equipped with two opposing magnets 310 spaced at a distance slightly larger than the width of the housing 230. When the housing 230 locates between two magnets 310, the magnets 310 attract the steel pin 242 apart from the cross piece 224, while compressing the spring 241. Then, the spring 250 pushes back the movable hook 220 to previous releasing position thus releasing the locking condition of the case 100.

However, the prior arts, like the security device mentioned above, has the problem of weak locking force as the prior arts employ the locking mechanism which is fixed to a locking position by the spring 241 which pushes the steel pin 242 against the side surface of the cross piece 224.

In addition, the prior art of security device has a defect of complex releasing operation process, as one has to hold the locking mechanism 200 with on hand and lift up the case 100 with the other hand, thus entailing the use of both hands.

SUMMARY OF THE INVENTION

The present invention was devised to solve above said problems of the prior art, and has the purpose of producing a security device capable of firmly maintaining the locking condition and with easy operation of locking and releasing.

The purposes of present invention are achieved by providing security devices including, a case for retaining an information storage device in the space between a front case and a rear case; at least one pair of locking sleeves protruding from the front case and the rear case in a way that one locking sleeve does not interfere with other locking sleeve and the holes of the sleeves are aligned in a straight line for an locking mechanism can be inserted through the holes of the sleeves, when the case is in closed condition. The locking mechanism includes a housing; a hook which is selectively locked to the protrusion formed on the locking sleeve and released from it by extruding from the case and pulling back into the case; an slope which inclines downward and are formed at the inner wall of the housing; a moving member which is mounted on the slope and moves up and down along the slope by magnetic force, while contacting with the side surface of the hook. The hook moves to the locking position or releasing position as the moving member goes up and down the slope.

The locking mechanism includes a cantilever-like elastic piece, which is elongated to the longitudinal direction of the housing, and the hook is attached to the free end of the elastic piece. The elastic piece makes a swing motion as the moving member moves along the slope thus transferring the hook into locking position or releasing position.

In addition, the locking mechanism can further include a fixing member which contacts with the hook and fixes the hook in the locking position. The fixing member is comprised of a body which is movably installed inside the housing and the end of which is selectively contacts with the hook; a spring which pushed the body toward the hook; a movable magnetic body which is installed at the opposing end of the body and attracted toward the opposite direction from the hook.

In addition, the locking mechanism can further include fixed magnetic body which is installed at the front end of the housing thus holding the locking mechanism in a specific location while the releasing operation.

The protrusion, to which the hook is locked, is preferably formed between a pair of parallel slits on the surface of locking sleeve, and the protrusion can be elastically deformed to the orthogonal direction from the advancing direction of the locking mechanism into the locking sleeves.

The present invention includes a decoupler for releasing the locking condition of the case. The decoupler is comprised of a guiding groove having the width slightly larger than the width of the case and also having an elongated shape along the longitudinal direction; a first magnet, which is located beneath the lower portion of the guiding groove and comes to be located beneath the lower part of the moving member when the locking mechanism is engaged to the decoupler thus attracting the moving member; a second magnet, which comes to be located behind the movable magnetic body and attracts the movable magnetic body to the opposite direction form said hook, when said locking mechanism is engaged to the decoupler; and a third magnet, which comes to be located in front of the fixed magnetic body and attracts the fixed magnetic body when the locking mechanism is engaged to the decoupler, thus holding the locking mechanism within the guiding groove.

BRIEF DESCRIPTION OF THE DRAWINGS

These and other objects of the present invention will become more readily appreciated and understood from a consideration of the following detailed description of the preferred embodiment when taken together with the accompanying drawings, in which.

DETAILED DESCRIPTION OF THE PREFERRED EMBODIMENTS

The preferred embodiment is illustrated in the following detailed description referring to the accompanying drawings.

Figure 1:
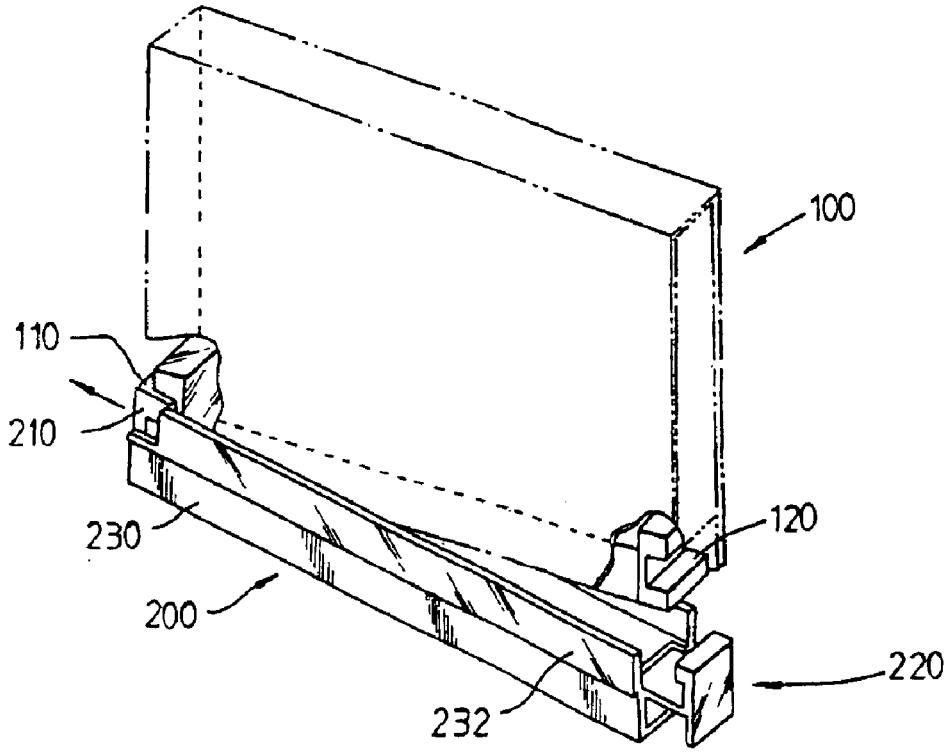
Fig.1 (Prior Art)
FIG. 1 is a view of the security device from the prior art.
Figure 2:
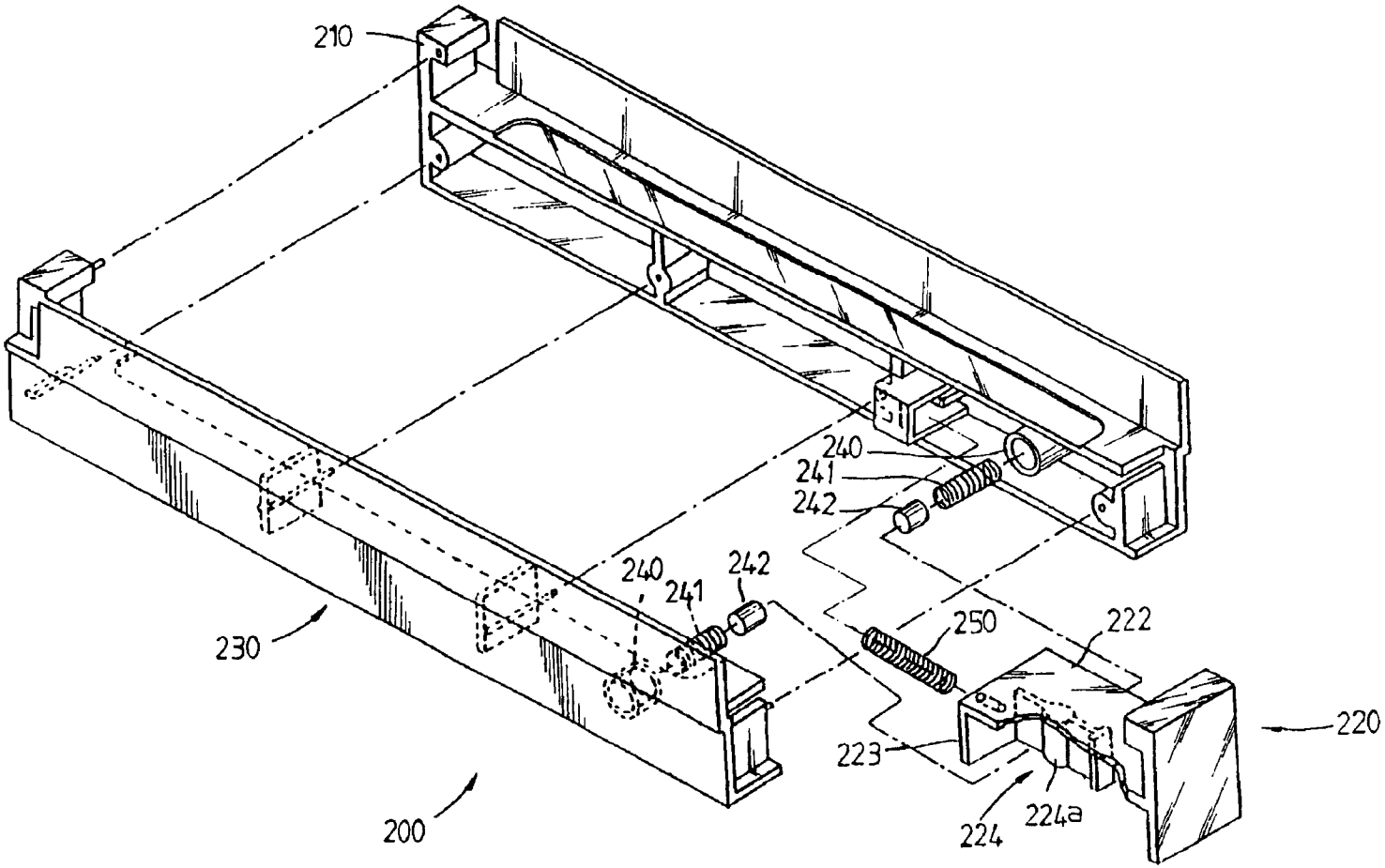
Fig.2 (Prior Art)
FIG. 2 is a broken view of the security device from the prior art.
Figure 3:
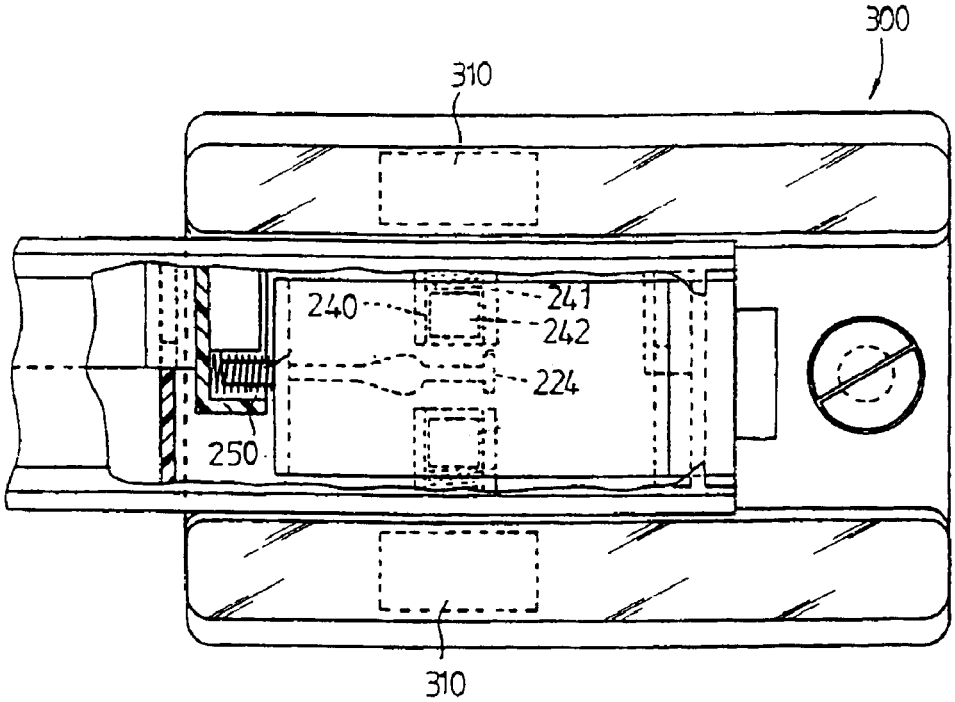
Fig.3 (Prior Art)
FIG. 3 is a cross sectional view of the security device from the prior art.
Figure 4:
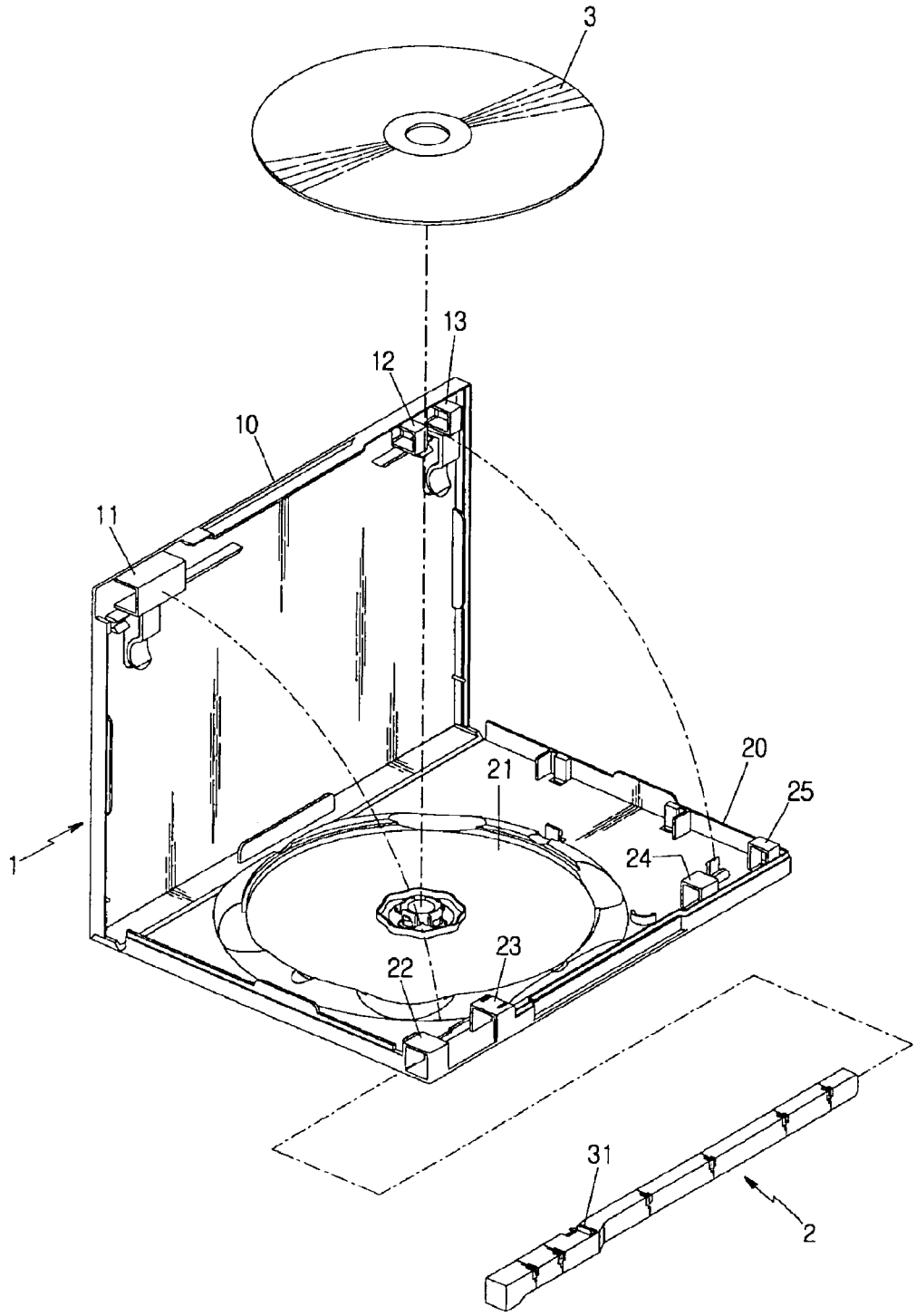
FIG. 4 is a perspective view of the security device according to the present invention.
Figure 5:
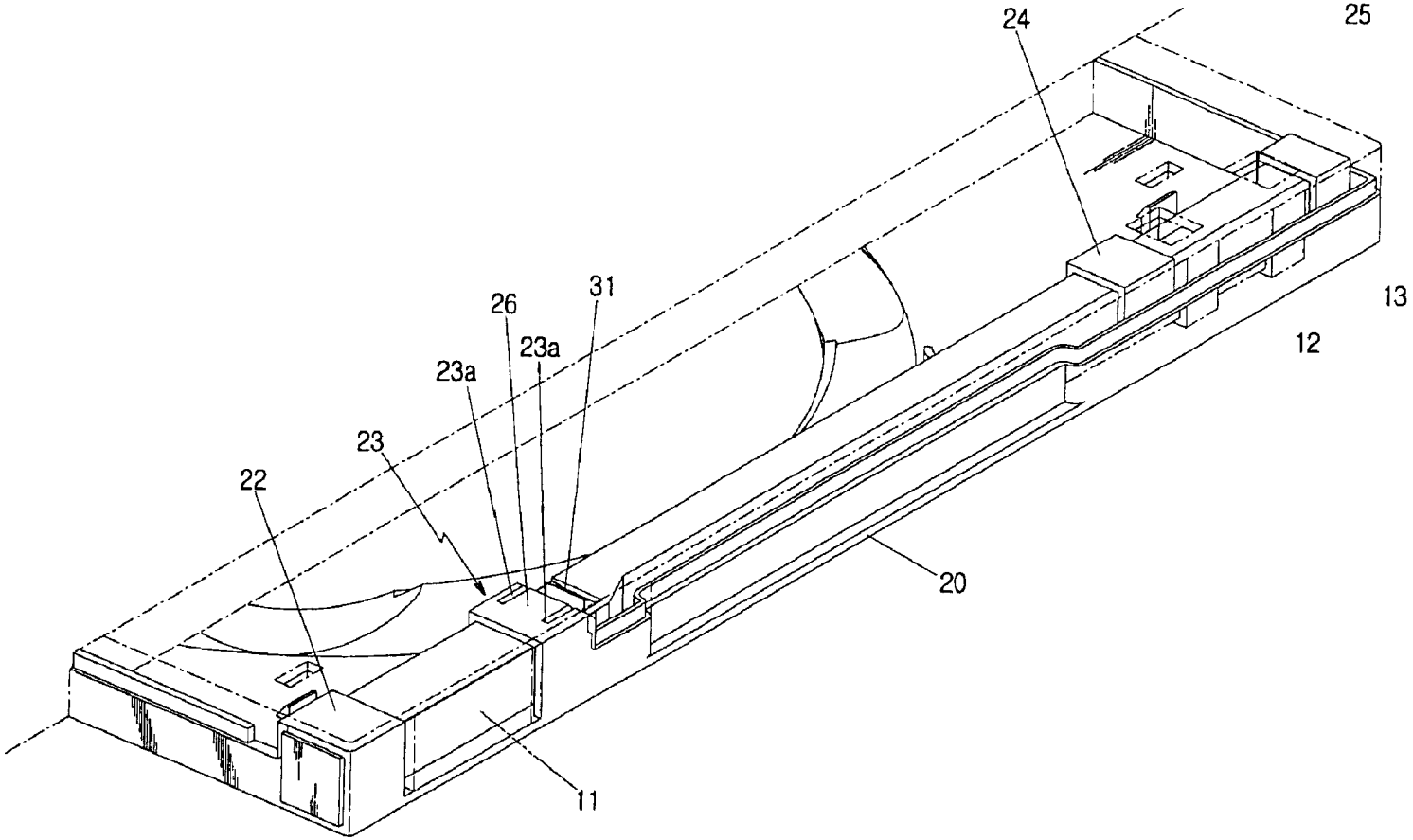
FIG. 5 is a partially enlarged view of the locking mechanism engaged to the case.

FIG. 4 is a perspective view of the security device according to present invention, and FIG. 5 is a partially enlarged perspective view of the security device according to present invention.

As shown in FIG. 4, the security device according to present invention includes a rectangular case 1 for retaining an information storage media 3 like CD, DVD in it's interior space; and a locking mechanism 2 for locking the case 1 lest it should be opened.

The case 1 has a front case 10 and rear case 20, which together forms space for retaining information storage media 3. The case 1 is opened or closed by the folding or unfolding operation of the front case 10 and rear case 20. The information storage media 3 is mounted on a recess 21 formed on the rear case 20 which is shaped after the shape of the information storage media 3 to be retained. Pluralities of locking sleeves 11, 12, 13 are formed at one side area of the front case 10 in a row. Plurality of locking sleeves 22, 23, 24, 25 are formed at one side area of the rear case 20, corresponding to the locking sleeves 11, 12, 13 of the front case 10.

As shown in FIG. 5, when the case 1 is closed, the locking sleeve 11 of the front case 10 places itself between the two locking sleeves 22, 23 of the rear case 20, and the other locking sleeves 12, 13 of the front case 10 between the two locking sleeves 24, 25 of the rear case 20. When the case 1 is closed, the locking sleeves are arranged in a row, and locking mechanism 2 is inserted through the locking sleeves thus locking the case in a closed status. A pair of slits 23*a*, which are parallel to the longitudinal direction, are formed on any one locking sleeve 23 of the rear case 20. A protrusion 26 is formed between the two slits 23*a*. A hook 31 is locked to the protrusion 26 when the locking mechanism 2 is inserted into the case 1 thus locking the case 1 in a closed status. Meanwhile, the locking sleeves 23 are made from elastic material, e.g. plastics, thus enabling the elastic deformation of the protrusion 26 to upward and downward. If compulsory force is applied to pull out the locking mechanism 2 from the case 1, the protrusion 26 deforms to the downward direction by the contact with the hook 31. As a result, it becomes more difficult for the hook 31 to be released from the protrusion 26 thus preventing the separation of the locking mechanism 2 from the case 1.

Figure 6:
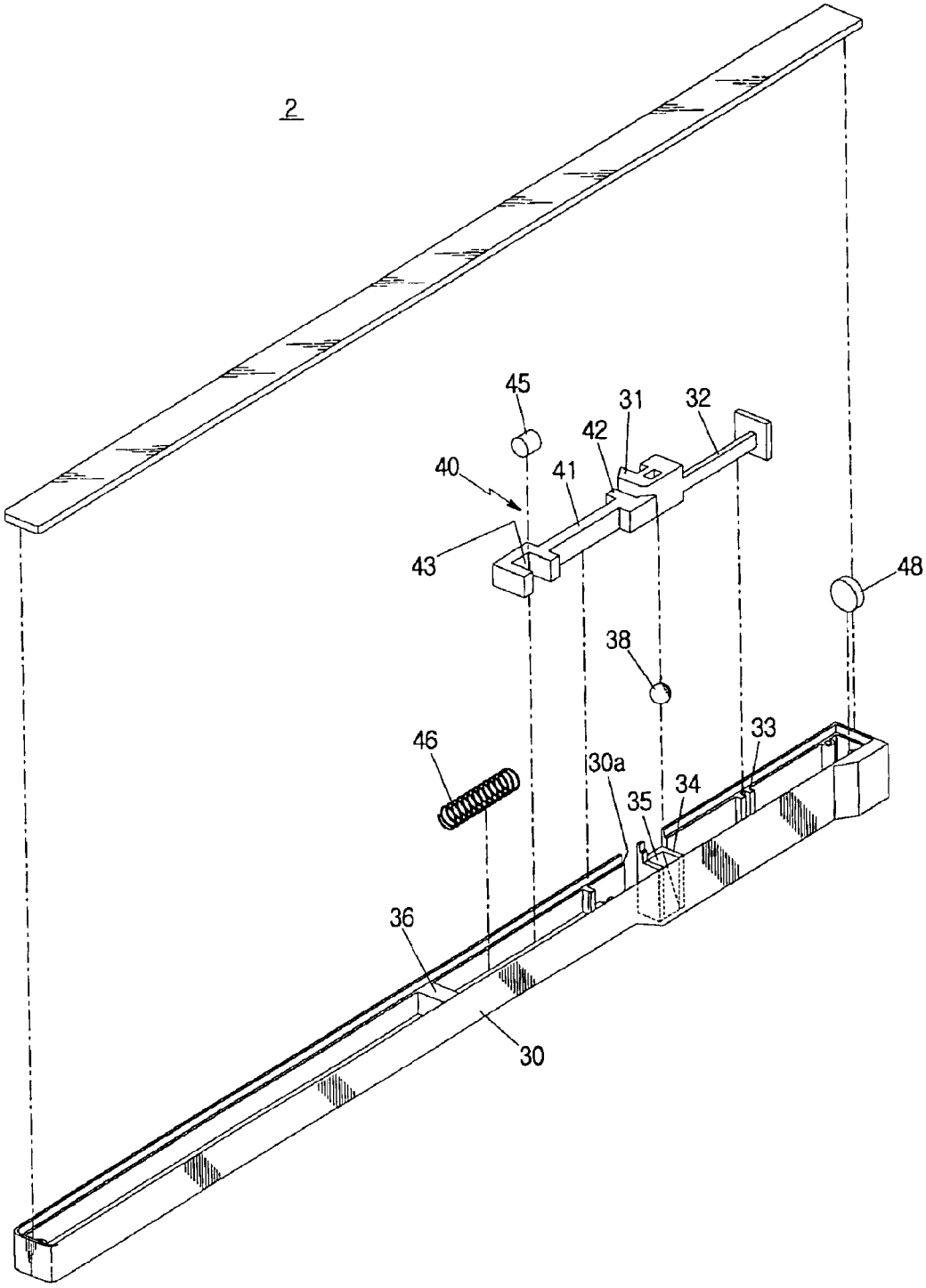
FIG. 6 is a broken perspective view of the security device according to the present invention.
Figure 7:
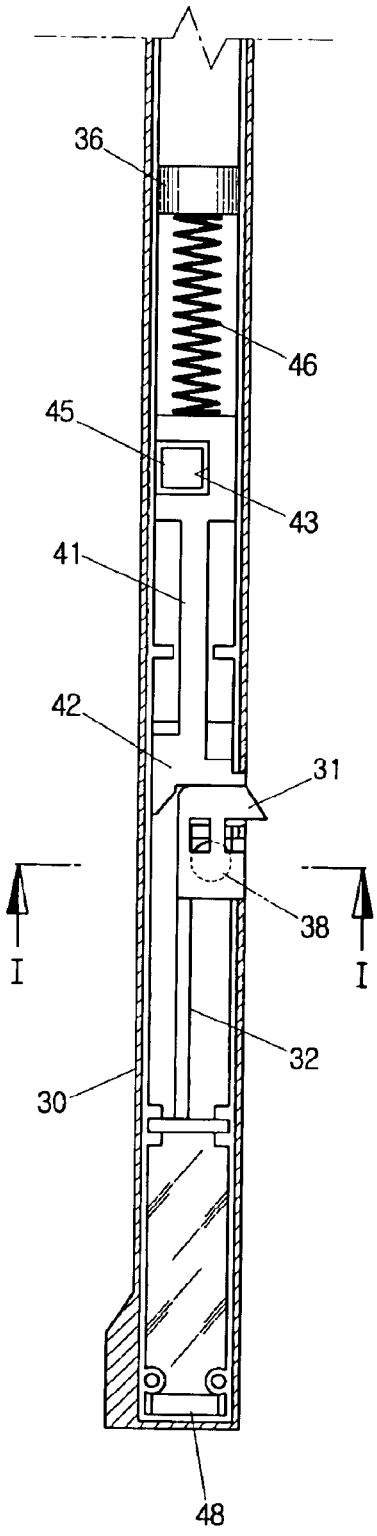
FIG. 7 is a horizontal cross sectional view of the security device according to the present invention.

FIG. 6 is a broken perspective view of the locking mechanism 2, and FIG. 7 is a horizontal cross sectional view of the locking mechanism 2.

As shown in FIG. 6 and FIG. 7, the locking mechanism 2 includes a housing 30 which has the shape of rectangular pipe with both ends blocked; and a slit 30*a* formed on one side of the housing 30 to the direction of width. A cantilever-shaped elastic piece 32 is properly installed inside the housing 30 so that the elastic piece 32 can make a swing motion inside the housing 30. The elastic piece 32 is fixed to the housing by inserting one end of the elastic piece 32 into the groove 33 provided inside the housing 30. Accordingly, the elastic piece 32 can be bent to the right and left with one end of the elastic piece 32 rooted in the groove 30. The hook 31 is formed at one end of the elastic piece 32 as one body. As elastic piece 32 swings to the width direction of the housing 30, the hook 31 selectively locks to the protrusion 26 formed on the rear case 20 by appearing from the housing 30 and disappearing into the housing 30. Meanwhile, a pair of spaced ribs 34 are formed vertically in the housing 30 near the slit 30*a*. At the space defined by the one pair of spaced ribs 34, is formed an slope 35 which inclines downward from the inner side wall of the housing 30. And, a globe-shaped moving member 38, made from steel material, is mounted on the slope 35.

Figure 8A:
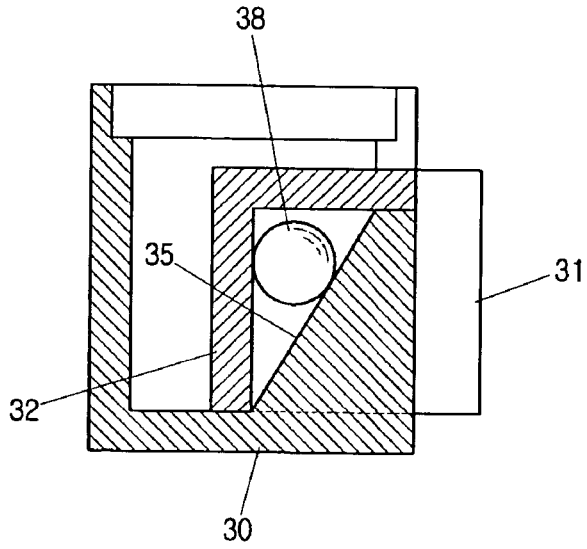
FIG. 8A is a cross sectional view according to the cutting line I—I of FIG. 7 showing the hook in a locked condition.
Figure 8B:
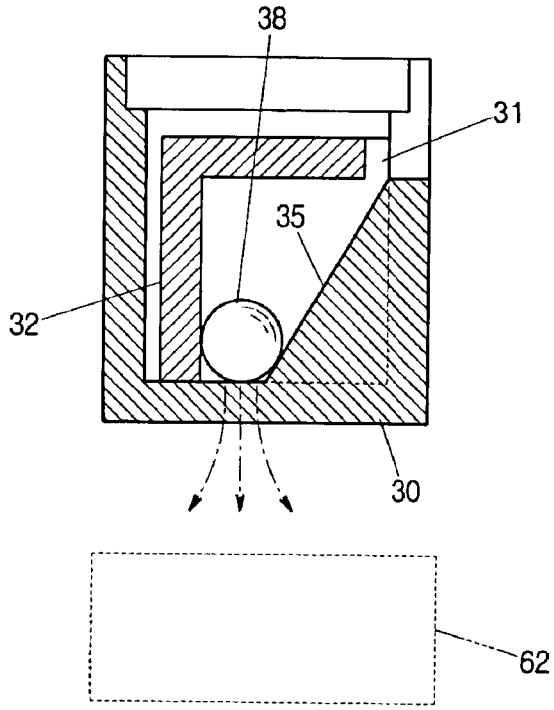
FIG. 8B is a cross sectional view according to the cutting line I—I of FIG. 7 showing the hook in a released condition.

As shown in FIG. 8A, the moving member 38, placed in the space defined by the inner side of the elastic piece 32 and the slope 35, forces the elastic piece 32 to swing as the moving member 38 climbs up and goes down the slope 35. FIG. 8A illustrates the locking status: wherein, the hook 31 protrudes from the housing 30 and locks into the protrusion 26; and the moving member 38 is located at the upper part of the slope 35. When the moving member 38 rolls down the slope 35 from the above position till it touches the bottom of the housing 30, the moving member 38 pushes back the elastic piece 32 so as the elastic piece 32 to be bent to the left, as shown in FIG. 8B. With the above-mentioned operation, the hook 31 is released from the protrusion 26 and goes into the housing 38, thus releasing the locking status. As locking status is released, the locking mechanism 2 is separated from the case 1, then the case 1 can be opened. The downward movement of the moving member 38 is made by a magnet 62 of a decoupler 2 (to be described hereinafter). In other words, when the housing 30 is moved to be placed above the magnet 62, the moving member 38 goes down the slope 35 by the magnetic force of the magnet 62, as shown in FIG. 8B. When the housing 30 is moved away from the magnet 62, the elastic piece 32 returns to it's original locking position by it's own elastic force and the moving member 38 goes upward along the slope 35, as shown in FIG. 8A.

In FIG. 6 or FIG. 7, reference number 40 denotes a fixing member, which is installed in a row with the hook 31 and fixes the hook 31 in the locking position. The fixing member 40 is comprised of a body 41 which has the longitudinally extended shape; a head 42 which has the shape of "L" and formed at one end of the body 41 to contact the hook 31; and a slot 43 which is formed at the other end portion of the body 41 and has the shape of "U" with it's opened mouth facing the side surface of the housing 30. A rib 36 is formed inside the housing 30 to face the fixing member 40. A spring 46 is inserted between the rib 36 and the fixing member 40. The fixing member 40 is pushed against the hook 31 by the spring 46. The elastic piece 32 cannot make a swing motion, while the fixing member 40 is in contact with the hook 31, accordingly locking the hook 31 in the locking position. As described above, the fixing member 40 prevents the releasing of the locking status, by fixing the position of the hook 31 and prohibiting the elastic piece 32 from abnormal deformations and et cetera. Meanwhile, a movable magnetic body 45 is placed in the slot 43 of the fixing member 40, to separate the fixing member 40 from the hook 31 in the releasing operation of the locking mechanism 2. The movable magnetic body 45 is attracted to the opposite direction from the hook 31 by another magnet which is installed in the decoupler, thus separating the fixing member 40 from the hook 31.

Reference number 48 denotes a fixed magnetic body 48 which is attached to the front end of the housing 30. The fixed magnetic body 48 is attracted by another magnet which is installed in the decoupler and attaches the locking mechanism 2 to the decoupler 60, thus maintaining the locking mechanism 2 within the decoupler 60.

Figure 9:
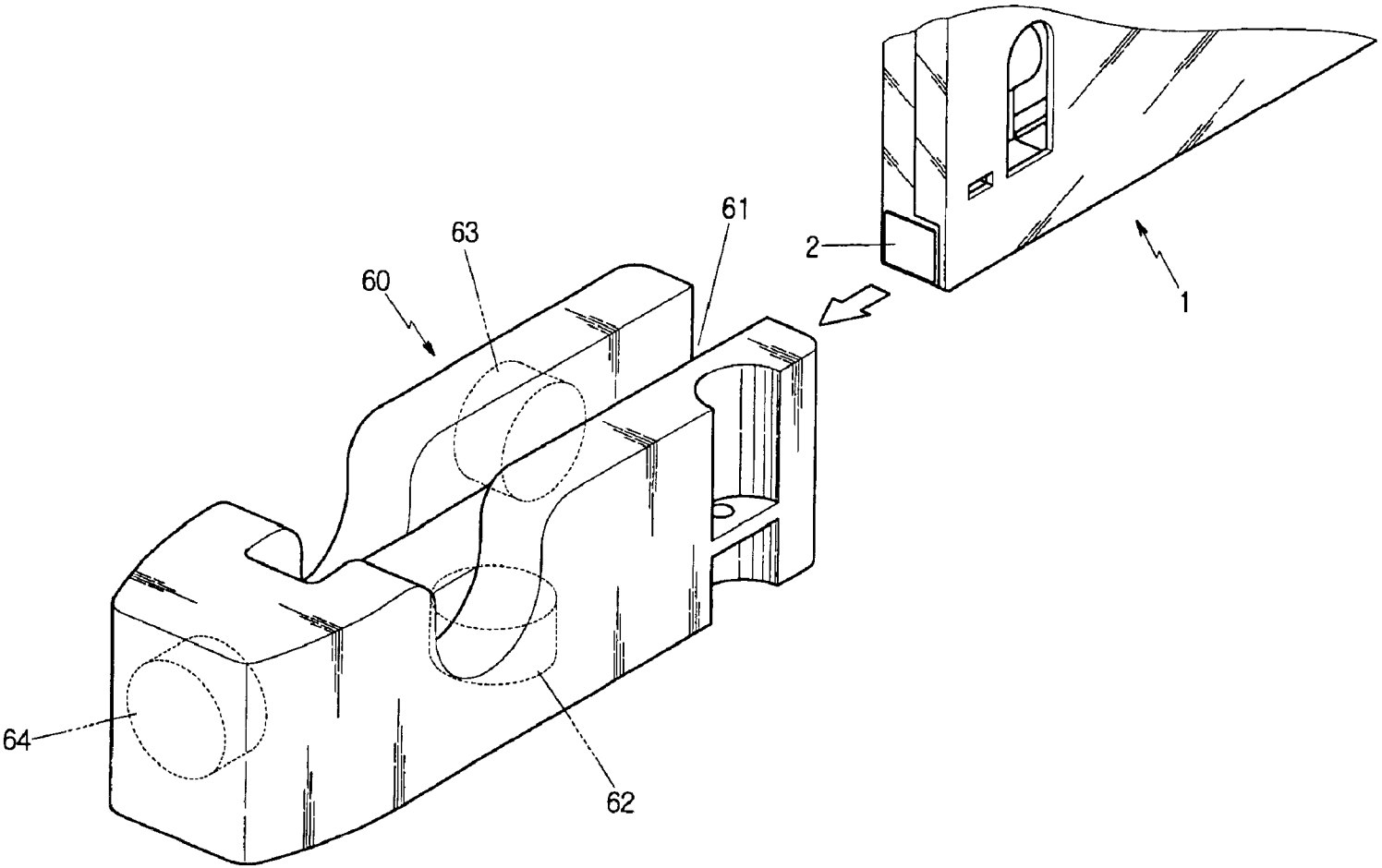
FIG. 9 is a perspective view of the decoupler.

FIG. 9 shows the decloupler for releasing the locking status of the case.

As shown in FIG. 9, the decoupler 60 is comprised of a guiding groove 61 having the width slightly larger than the width of said case 1 and also having an elongated shape along the longitudinal direction; a first magnet 62, which is installed beneath the lower portion of said guiding groove 61 corresponding to the moving member 38; a second magnet 63, which is installed in the side portion of the guiding groove 61 corresponding to the movable magnetic body 45; and a third magnet 64, which is installed in the front portion of the guiding groove 61 corresponding to the fixed magnetic body 48. As the case 1 advances through the guiding grooves 61, to the direction of the arrow shown on the FIG. 9, the case 1 is released by the magnetic forces exerted by the magnets 62, 63, 64.

Figure 10A:
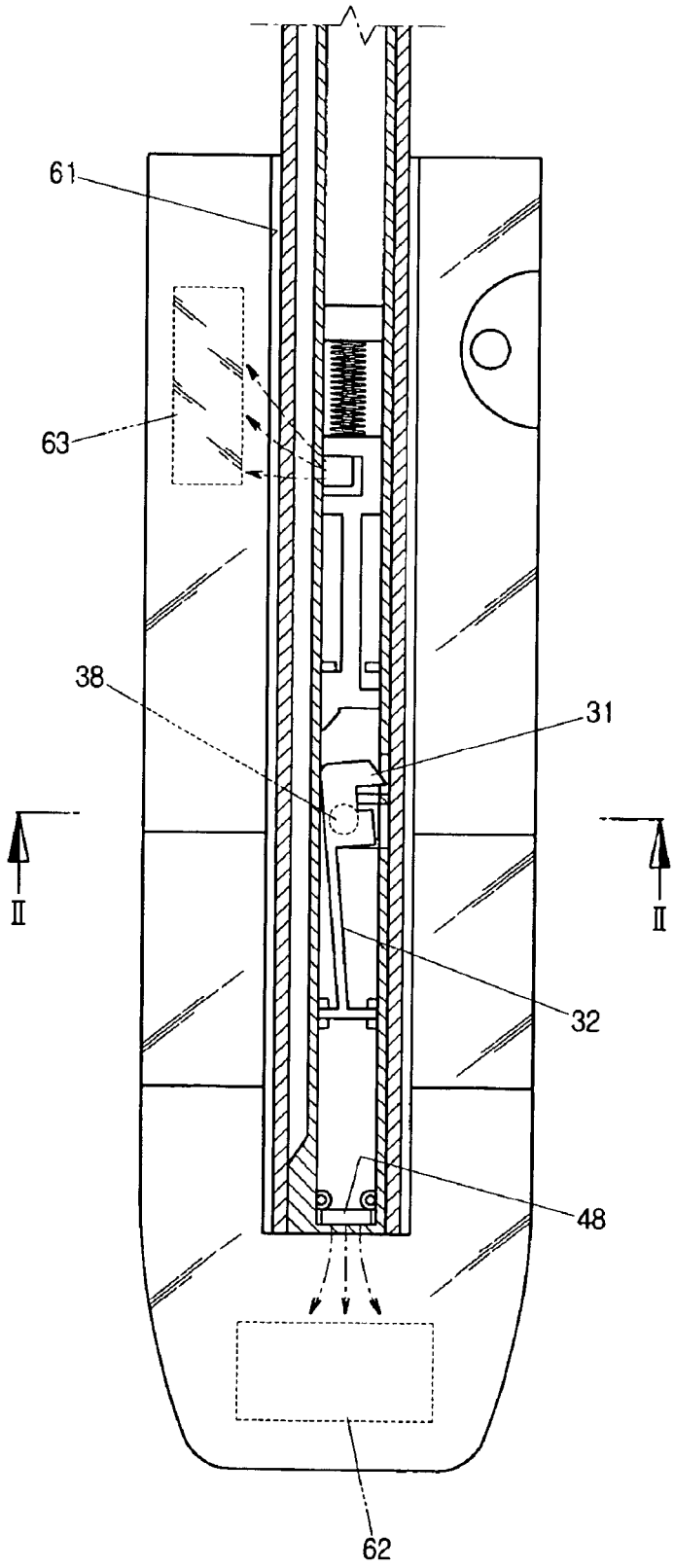
FIG. 10A is a cross sectional view of security device according to the present invention, showing the releasing operation of the decoupler.
Figure 10B:
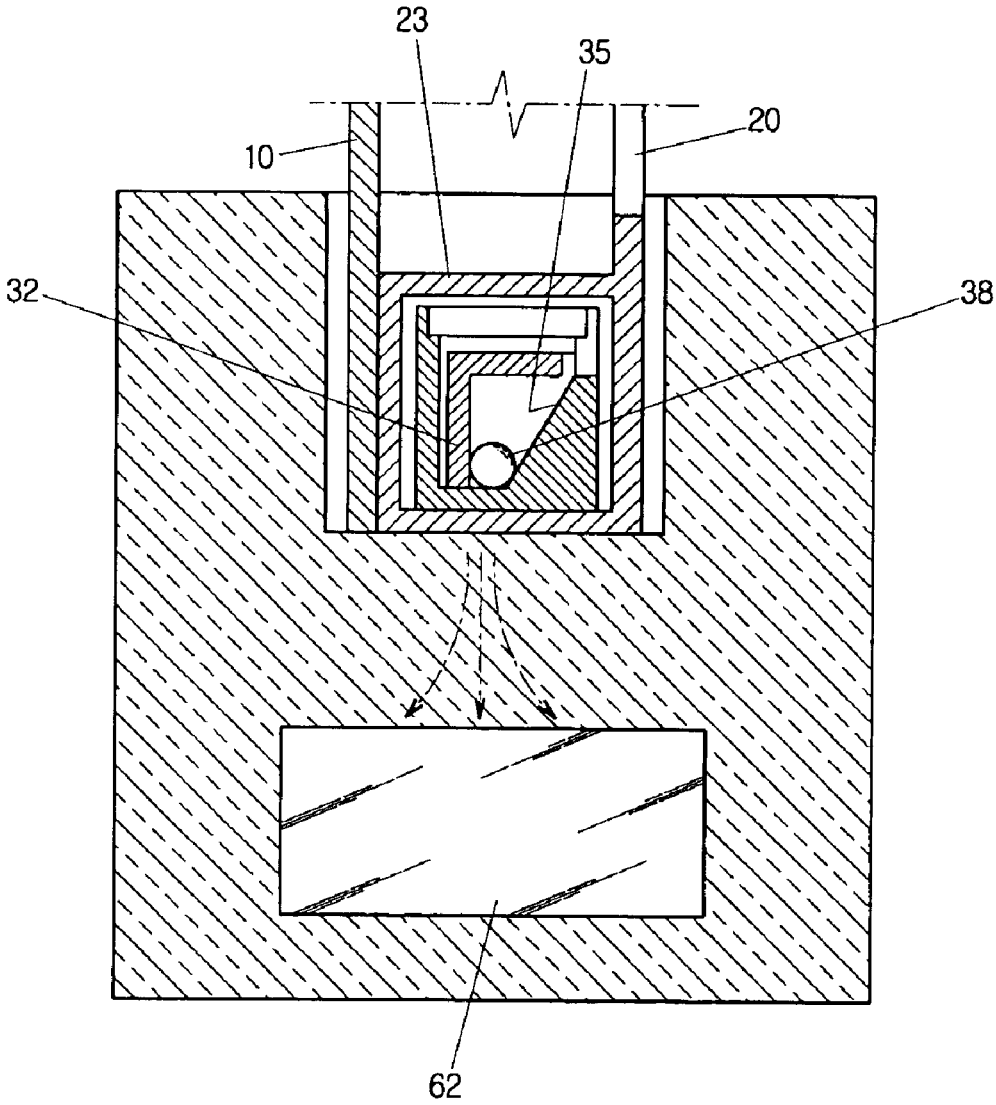
FIG. 10B is a cross sectional view according to the cutting line II—II of FIG. 10A.
Figure 11:
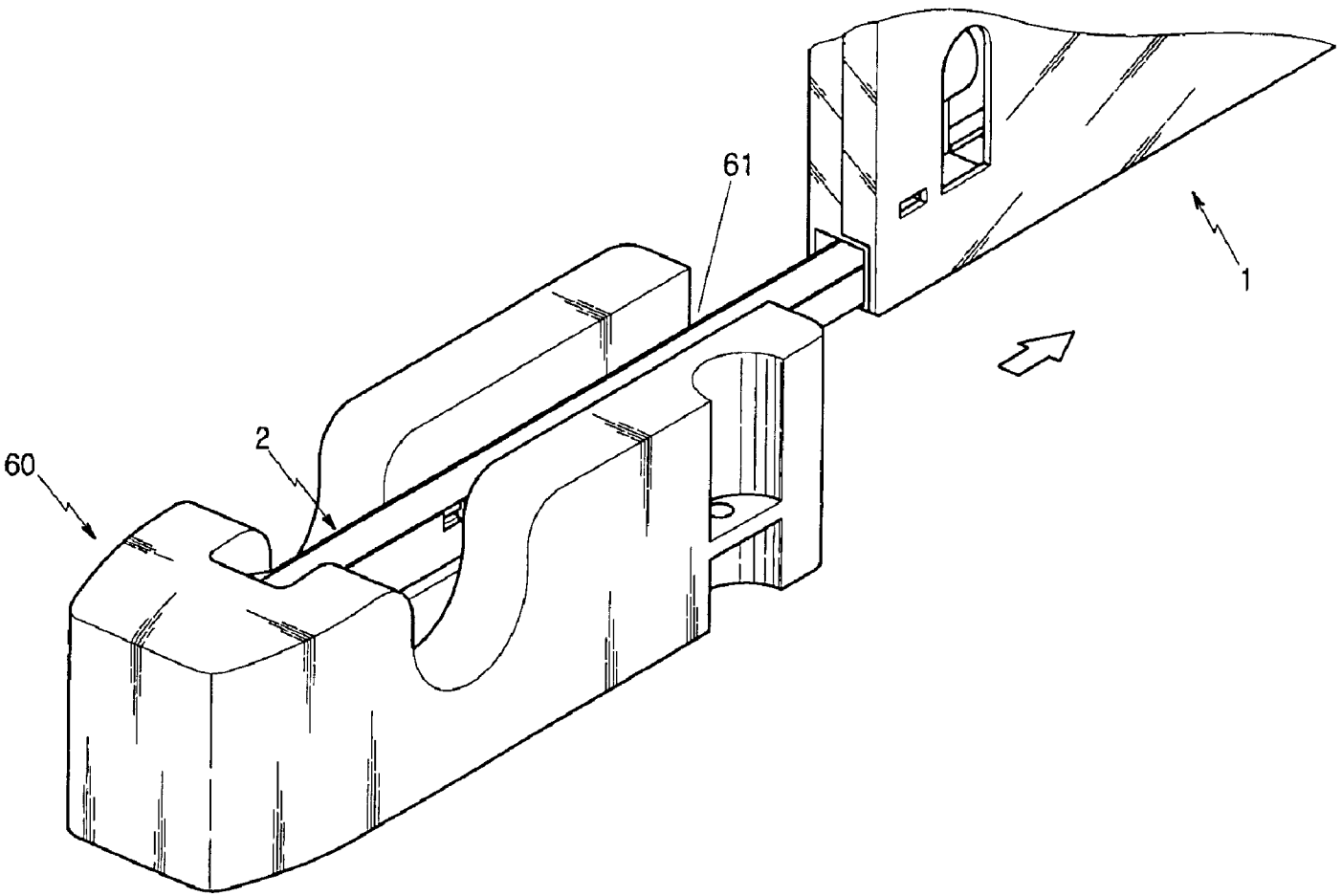
FIG. 11 is a perspective view of the status when the case is separated from the locking mechanism.

Referring now to FIGS. 10A, 10B and 11, the releasing operation by the decoupler 60 is explained.

As shown in FIG. 10A, when the case 1 fully advances through the guiding groove 61, the second magnet 63 comes to be positioned at the rear direction of the movable magnet 45. The movable magnetic body 45 is attracted to the rear direction by the second magnet 63. Accordingly, the fixing member 40 retracts from the hook 31 compressing the spring 46, thus eliminating the constriction which bounds the hook 31 and elastic piece 32.

As shown in FIG. 10B, the first magnet 62 comes to be positioned beneath the moving member 38. The first magnet 62 attracts the moving member 38 so that the moving member 38 rolls down the slope 35 while pushing the elastic piece 32 to the left direction in the FIG. 10B. Accordingly, the hook 31 is released from the protrusion 26 of the rear case 20 and moves into the releasing position, thus releasing the locking status.

Meanwhile, the fixed magnetic body 48 installed at the front end of the housing 30 is attracted to the third magnet 62. At this moment, the user holds the case 1 and moves the case 1 backward along the guiding groove 61, as shown in FIG. 11. Then the case 1 comes out of the guiding groove 61 while the locking mechanism 2 still remaining in the guiding groove 61. As a result, the case 1 is completely separated from the case 1 and the case 1 can be opened.

Figure 12:
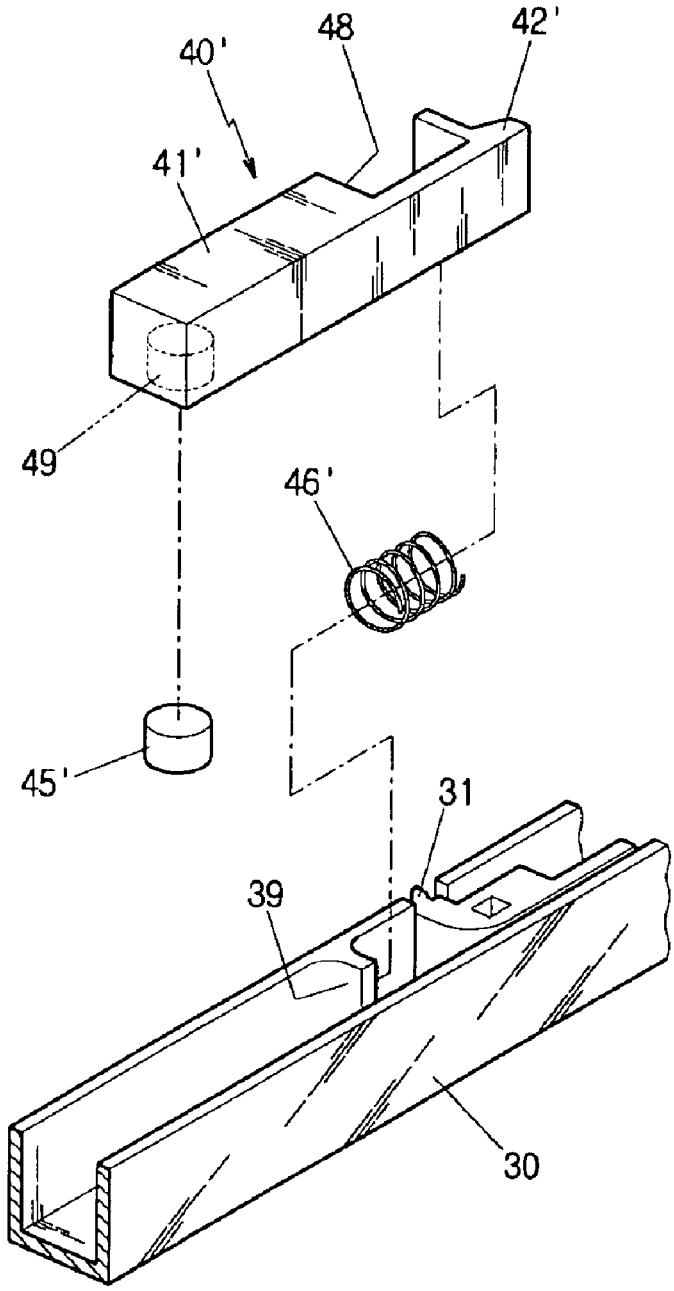
FIG. 12 is a broken perspective view of another embodiment of the locking mechanism according to the present invention.
Figure 13:
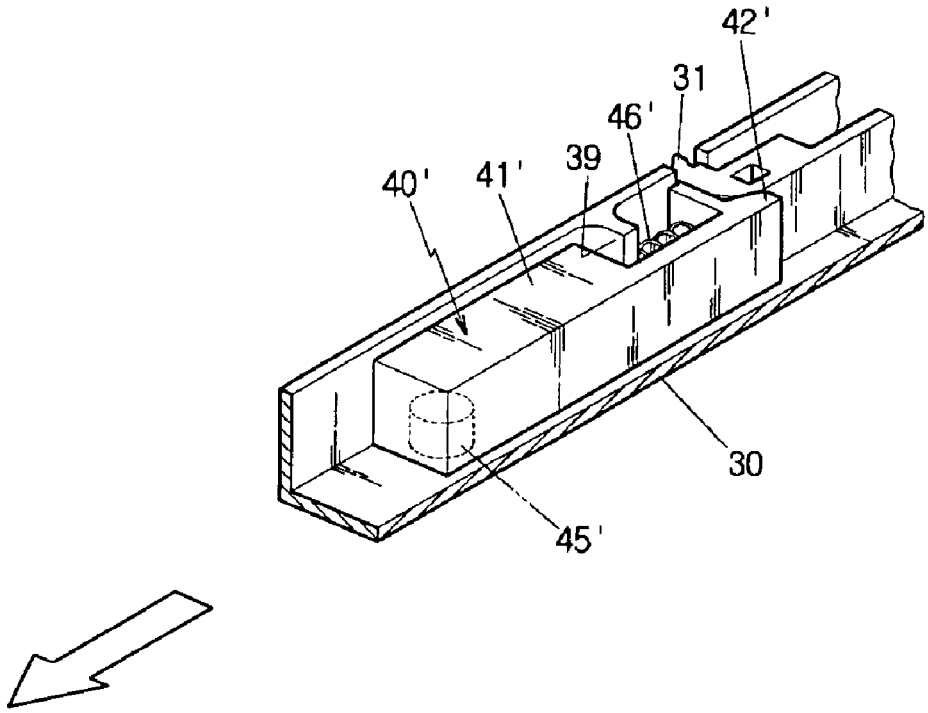
FIG. 13 is a perspective view showing the status when the locking mechanism according to FIG. 12 is engaged; and, FIG. 14 is a perspective view of decoupler according to another embodiment of the present invention.
Figure 14:
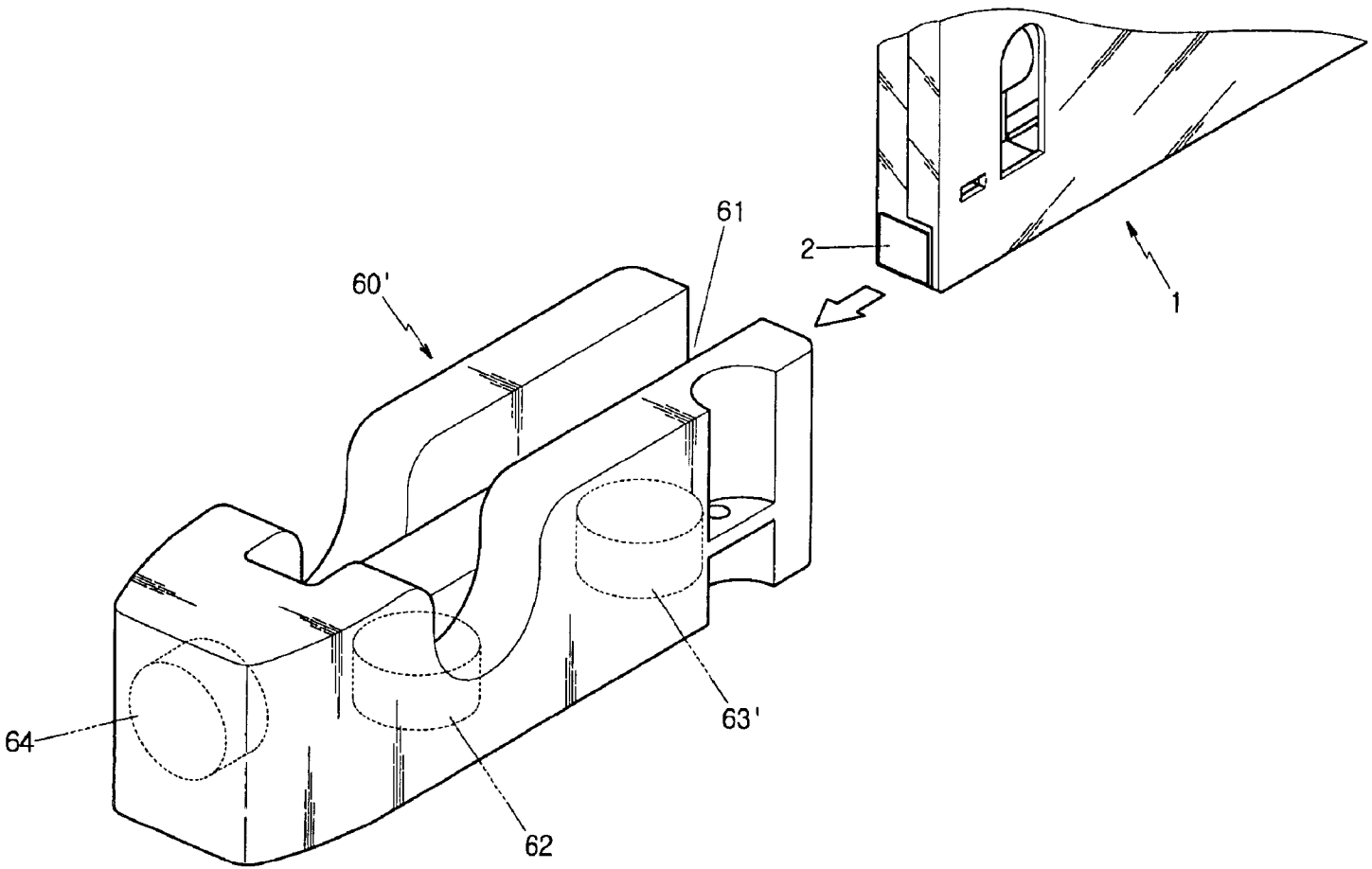

FIG. 12 to FIG. 14 show the another embodiment of present invention. The embodiment in FIG. 12 to FIG. 14 is different from the embodiment in FIG. 1 to FIG. 11 only in the shape of the fixing member and decoupler.

As shown in FIG. 12 and FIG. 13, the fixing member 40' according to another embodiment of the present invention is comprised of a body 41' which has the longitudinally extended shape along the housing 30; a head 42' which has the shape of "L" and formed at one end of the body 41' to contact the hook 31; and a groove 48 which is formed at the other end portion of the body 41' to the longitudinal direction of the body 41'. At the inner wall of the housing 30 is formed a rib 39 which protrudes toward the groove 48. A spring 46' is installed between the rib 39 and the inner wall of the housing 30. The fixing member 40' is pushed against the hook 31 by the spring 46'. The hook 31 is fixed to the locking position as the elastic piece 32 can't make a swing motion while the hook 31 is in contact with the fixing member 40'. The movable magnetic body 45' is installed in the groove 49 which is provided at the bottom and the rear portion of the movable magnetic body 45', so that the movable magnetic body 45' comes to be positioned to face the bottom of the guiding groove 61 when the locking mechanism is inserted to the guiding groove 61.

Corresponding to the above said movable magnetic body 45', the decoupler 60' has a second magnet 63' installed under the bottom and near the entrance of the guiding groove 61. When the locking mechanism 2 is fully inserted to the guiding groove 61, the second magnet 63' comes to be located at the rear portion of the movable magnet 45' and as a result, the second magnet 63' attracts the fixing member 40' to the direction of an arrow which is shown on FIG. 13 thus separating the fixing member 40' from the hook 31.

In the above-mentioned embodiments, the case 1 was comprised of the front case 10 and rear case 20 which are joined in a foldable structure and formed as one body. However, the shape and structure of the case 1 is not limited to the above-mentioned case 1. The other possible structures like, completly separable structure of front case 10 and rear case 20, or the hinge-connected structure of front case 10 and rear case 20 cetra et cetera, can be employed.

In the above-mentioned embodiments, the hook 31 was moved to the locking position or releasing position by the elastic movement of the elastic piece 32. However, in place of the elastic piece 32, any means that can apply elastic force to the hook 31, like spring, may be used.

In the above-mentioned embodiments, there were plurality of locking sleeves on the front case 10 and the rear case 20. However, only one locking sleeve on each of the front case 10 and the rear case 20 may be possible. In this case, the locking mechanism 2 needs not to be as long as the length of the case 1, but can be made much shorter.

According to present invention, as illustrated above, the security device can prevent the pilferage of the information storage media, like CD and DVD, as the security device can only be released by the decoupler.

Especially, the present invention can secure the firm locking status of the case, as the security device has the locking structure wherein the hook of the locking mechanism is locked to the protrusion formed on the case, and the fixing member fixes the hook in the locking position, thus preventing the releasing of locking status in an unexpected situation.

In addition, as the locking mechanism remains within the decoupler after the releasing operation, the user can hold the case with one hand and separate it. That is, the present invention enables the simple releasing operation with only one hand.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A security device comprising:

a case having a front case and a rear case which are combined to be opened and closed, said front case and said rear case defining an interior volume for retaining an information storage media;

plurality of locking sleeves protruding from said front case and said rear case, said locking sleeves formed to engage each other in the manner that the holes of said locking sleeves are aligned in a closed position of said case; and a locking mechanism for latching said case, said locking mechanism inserted into the aligned holes of said locking sleeves in closed position of said case, and said locking mechanism including;

a housing, a hook selectively locking to a protrusion formed on one of the locking sleeves by emerging from said housing and pulling back into said housing, a slope formed on the inner wall of said housing which inclines downward, and a moving member mounted on said slope, said moving member moving up and down along the slope while contacting one side surface of said hook, and said hook moving to the locking position or relieving position as said moving member moving up and down along the slope.

2. The security device of claim 1, wherein said locking mechanism further includes an elastic piece, said elastic piece has a cantilever-like elongated shape along the longitude direction of said housing and one end of said elastic piece is fixed to the inner area of said housing, and said hook is connected at a free end of said elastic piece so that said hook moves to locking position or relieving position, as said elastic piece makes swing motion forcing said moving member, mounted on said slope, to move up and down along the slope while said moving member contacting one side surface of said hook.

3. The security device of claim 2, wherein said locking mechanism further includes a fixing member for fixing said hook in the locking position by being positioned to contact with said hook.

4. The security device of claim 3, wherein said fixing member includes a body which is movably installed inside said housing, and the front end of said body selectively contacts with said hook; and a spring which pushes said body toward said hook.

5. The security device of claim 4, wherein said fixing member further includes a movable magnetic body which is located at a latter part of said body of the fixing member, said magnetic body being attracted toward the opposite direction form said hook by magnetic force.

6. The security device of claim 2, wherein said locking mechanism further includes a fixed magnetic body which is located at an end of said housing so as to maintain said locking mechanism in a specific position when said locking mechanism is released.

7. The security device of claim 1, wherein said moving member is a steel ball.

8. The security device of claim 1, wherein said protrusion is disposed between two parallel slits formed on any one surface of said locking sleeves, and said protrusion elastically moves orthogonal to a marching direction of said locking mechanism.

9. The security device of claim 1 further comprising a decoupler for releasing the locking status of said locking mechanism, and said decoupler comprising:

a guiding groove having the width slightly larger than the width of said case, and said guiding groove also having an elongated shape along the longitudinal direction; and a magnet, which is located beneath a lower portion of said guiding groove and when said locking mechanism is engaged to said decoupler, said magnet comes to be located beneath the lower part of said moving member thus attracting said moving member downward.

10. The security device of claim 5 further comprising a decoupler for releasing the locking status of said locking mechanism, and said decoupler comprising:

a guiding groove having the width slightly larger than the width of said case, and also having an elongated shape along the longitudinal direction;

a first magnet, which is located beneath a lower portion of said guiding groove and when said locking mechanism is engaged to said decoupler, said magnet comes to be located beneath the lower part of said moving member thus attracting said moving member downward; and a second magnet, which comes to be located at the rear of said movable magnetic and attracts said movable magnetic body to the opposite direction form said hook, when said locking mechanism is engaged to said decoupler.

11. The security device of claim 6 further comprising a decoupler for releasing the locking status of said locking mechanism, and said decoupler comprising:

a guiding groove having the width slightly larger than the width of said case, and also having an elongated shape along the longitudinal direction;

a first magnet, which is located beneath a lower portion of said guiding groove and when said locking mechanism is engaged to said decoupler, said magnet comes to be located beneath the lower part of said moving member thus attracting said moving member downward; and a third magnet, which comes to be located in front of said fixed magnetic body and attracts said fixed magnetic body, when said locking mechanism is engaged to said decoupler, thus maintaining said locking mechanism within said guiding groove.

12. The security device of claim 5, wherein said locking mechanism further includes a fixed magnetic body installed at the front end of said housing.

13. The security device of claim 12, wherein said locking mechanism further includes a decoupler for releasing the locking status of said locking mechanism, and said decoupler comprising:

a guiding groove having the width slightly larger than the width of said case, and also having an elongated shape along the longitudinal direction;

a first magnet, which is located beneath a lower portion of said guiding groove and when said locking mechanism is engaged to said decoupler, said magnet comes to be located beneath the lower part of said moving member thus attracting said moving member downward;

a second magnet, which comes to be located rear of said movable magnetic and attracts said movable magnetic body to the opposite direction from said hook, when said locking mechanism is engaged to said decoupler; and, a third magnet, which comes to be located in front of said fixed magnetic body and attracts said fixed magnetic body, when said locking mechanism is engaged to said decoupler, thus maintaining said locking mechanism within said guiding groove.

* * * * *